US005263877A

United States Patent [19]

Mitani

[11] Patent Number: 5,263,877

[45] Date of Patent: Nov. 23, 1993

[54] L-SHAPED COAXIAL CABLE CONNECTOR

[75] Inventor: Ikujiro Mitani, Tokyo, Japan

[73] Assignee: Hirose Electric Co., Ltd., Tokyo, Japan

[21] Appl. No.: 850,305

[22] Filed: Mar. 12, 1992

[30] Foreign Application Priority Data

Mar. 12, 1991 [JP] Japan ..... 3-070415

[51] Int. Cl.[5] ..... H01R 17/04

[52] U.S. Cl. ..... 439/585; 439/582

[58] Field of Search ..... 439/578-585, 439/675, 852, 736; 29/828, 857, 861, 863, 867

[56] References Cited

U.S. PATENT DOCUMENTS

| | | | |
|---|---|---|---|
| 4,178,054 | 12/1979 | Laudig | 439/394 |
| 4,678,261 | 7/1987 | Mitani et al. | 439/582 |
| 5,037,329 | 8/1991 | Wright | 439/582 |
| 5,110,308 | 5/1992 | Nishikawa et al. | 439/582 |

FOREIGN PATENT DOCUMENTS 2-6626 2/1990 Japan .

*Primary Examiner*—David L. Pirlot

*Attorney, Agent, or Firm*—Kanesaka & Takeuchi

[57] ABSTRACT

A coaxial cable connector includes an L-shaped outer conductive shell (1) having a tubular trunk section (6) with a front coupling mouth (9) and a rear connection opening (10) and a holder section (7) extending laterally from the trunk section for holding a coaxial cable (4); an L-shaped dielectric member (2) housed in the outer conductive shell and having a front tubular portion with an aperture (2*a*) therein and a rear portion for holding the coaxial cable; and a central terminal (3) housed in the aperture and having a front portion (3*a*) for contact with a mating connector and a rear portion (3*b*) for connection to a central conductor of the coaxial cable. The holder section has a pair of wing portions (11) bent around the rear section of the dielectric member.

7 Claims, 3 Drawing Sheets

L-SHAPED COAXIAL CABLE CONNECTOR

BACKGROUND OF THE INVENTION

1. Field of the Invention

The present invention relates to an L-shaped coaxial cable connector and a method of connecting a coaxial cable to it.

2. Description of the Prior Art

The well known L-shaped coaxial cable connectors include one in which a central terminal is held by a dielectric member within a tubular outer conductive shell. Such a coaxial cable connector has an opening on a side of the outer conductive shell in order to connect a coaxial cable in a direction perpendicular to the axis of the outer conductive shell. The central conductor of the coaxial cable is soldered to the rear groove of the central terminal for connection. A tubular holder extends along the coaxial cable from the opening in order to hold the coaxial cable. A sleeve is then put over and crimped onto the holder and the coaxial cable for securing the coaxial cable.

In the above connector, however, it is very difficult to solder the central conductor to the central terminal within a small space in the outer conductive shell, resulting in frequent defective soldering. In addition, the separate holder increases the number of assembly steps and thus the manufacturing cost.

In order to improve the above shortcoming, Japanese U.M. Patent Application Kokoku No. 2-6626 proposes a coaxial cable connector which includes an outer conductive shell having a holder portion extending outwardly from a side of the shell; a central terminal having a rear portion bent at right angles to the axis of the shell; and a outer terminal crimped over the central conductor of a coaxial cable and press-fitted over the rear portion of the central terminal. A sleeve is put over the coaxial cable, and the outer terminal, which has been crimped to the central conductor, is press-fitted over the connection portion by pushing the coaxial cable so that the holder portion is disposed between the shield wire and the inner dielectric member of the coaxial cable. The connection portion has a slit on the circumference so that when the outer terminal is press-fitted, it can expand and hold the outer terminal firmly. Then, the sleeve is crimped to secure the coaxial cable to the holder portion thus connecting the coaxial cable to the connector. With this connector, it is easy to secure a coaxial cable to the connector without soldering and a separate holder.

In the above connector, however, it is necessary to crimp an outer terminal to the central conductor of a coaxial cable so that the end portion of the coaxial cable must be prepared. In addition, the central conductor, the outer terminal, and the central terminal are arranged one upon another so that it is impossible to provide a miniature connector.

SUMMARY OF THE INVENTION

Accordingly, it is an object of the invention to provide a coaxial cable connector which requires no outer terminal and permits easy connection of a coaxial cable thereto.

It is another object of the invention to provide a method of connecting a coaxial cable to the above coaxial connector.

According to an aspect of the invention there is provided a coaxial cable connector which includes an L-shaped outer conductive shell having a tubular trunk section with a front coupling mouth and a rear connection opening and a holder section extending laterally from the trunk section for holding a coaxial cable; an L-shaped dielectric member housed in the outer conductive shell and having a front tubular portion with an aperture therein and a rear portion for holding the coaxial cable; and a central terminal housed in the aperture and having a front portion for contact with a mating connector and a rear portion for connection to a central conductor of the coaxial cable.

According to another aspect of the invention there is provided a method of connecting a coaxial cable to the above coaxial cable connector which includes the steps of removing a length of outer jacket of a coaxial cable to expose a shield wire, an inner dielectric member, and a central conductor; pushing a tubular ferrule into a space between the shield wire and the inner dielectric member; crimping the central conductor to a rear portion of the central terminal; inserting a front portion of the central terminal into the front section of the dielectric member; bending the holder section in a direction perpendicular to a longitudinal axis of the trunk section; and crimping the holder section onto the dielectric member, the central terminal, and the central conductor.

With the coaxial cable connector and method of connecting a coaxial cable to the connector, it is easy to assemble a miniature coaxial cable connector without using any separate outer terminal.

The above and other objects, features, and advantages of the invention will be apparent from the following description when taken in conjunction with the accompanying drawings.

DESCRIPTION OF THE PREFERRED EMBODIMENT

Figure 1:
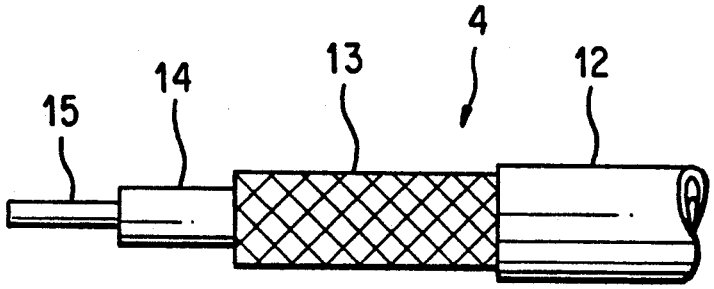
FIG. 1 is a side elevational view of an end portion of a coaxial cable prepared in the first step of a cable preparation method according to the invention.
Figure 2:
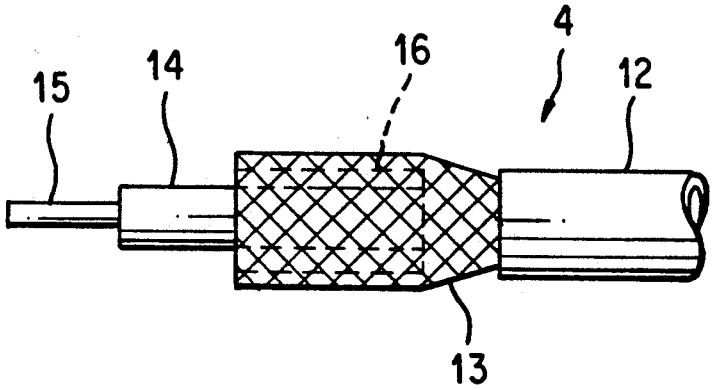
FIG. 2 is a side elevational view of the end portion prepared in the second step of the preparation method.
Figure 3:
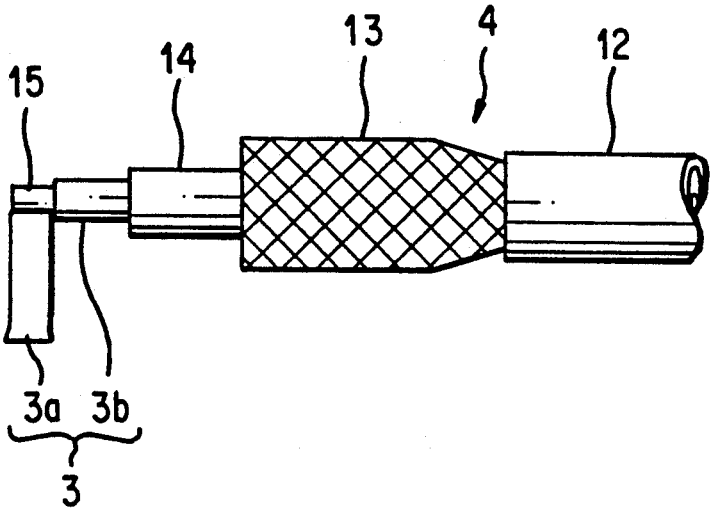
FIG. 3 is a side elevational view of the end portion prepared i third step of the preparation method.
Figure 4:
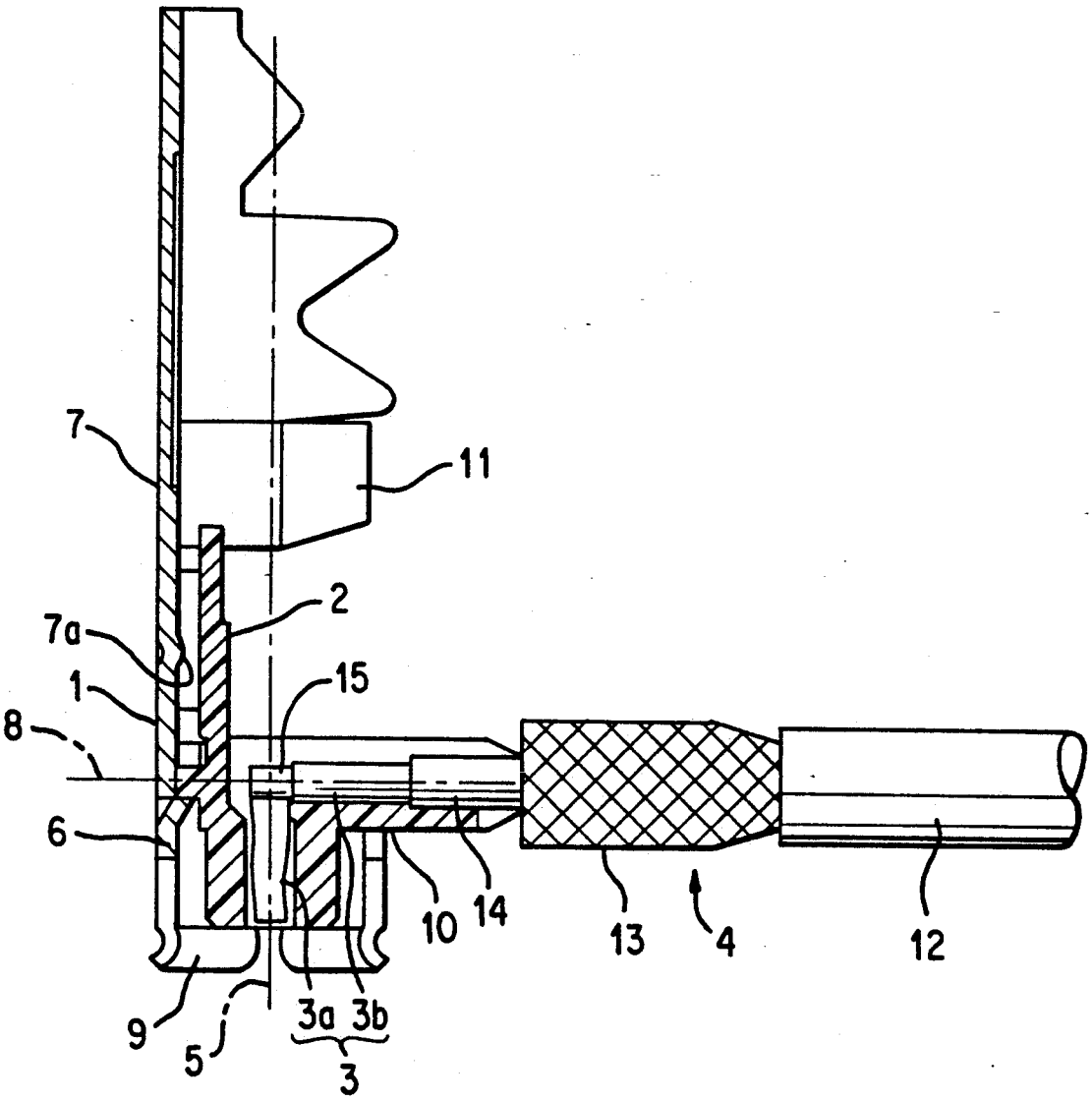
FIG. 4 is a side elevational view of a coaxial cable connector in the first step of a connector assembly method according to the invention.
Figure 5:
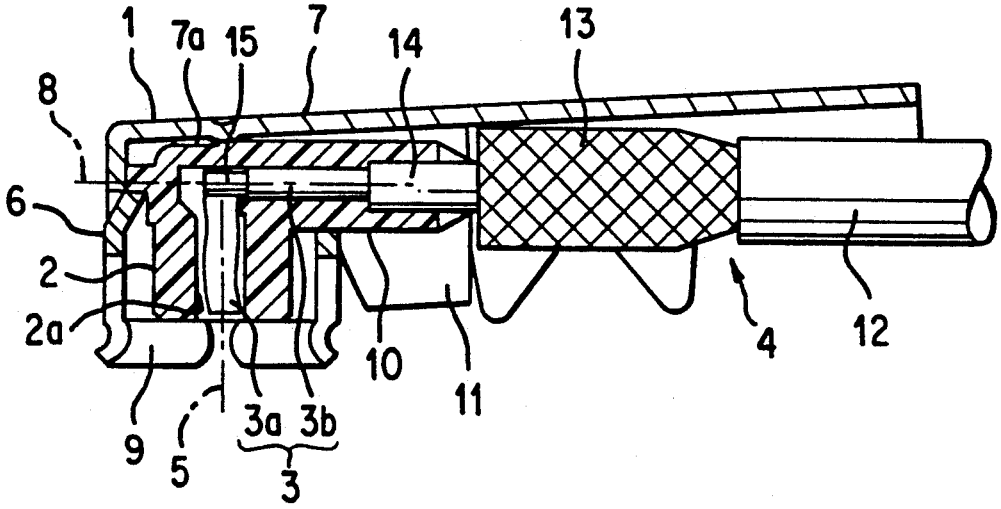
FIG. 5 is a side elevational view of the coaxial cable connector in the second-step of the assembly method.

FIGS. 1–6 show how a coaxial cable connector is made according to the invention. FIGS. 1–3 show how the end portion of a coaxial cable is prepared and connected to the central terminal. FIGS. 4 and 5 show how the central terminal is inserted into the connector proper, crimped, and assembled.

The structure of a coaxial connector according to an embodiment of the invention is described with reference to FIGS. 4 and 5. An outer conductive shell 1 has a tubular and then U-shaped cross section. A dielectric member 2 holds a central terminal 3 within the tubular portion of the outer conductive shell 1. A coaxial cable 4 is connected to the central terminal 3.

The outer conductive shell 1 is stamped and formed from sheet metal so as to have a tubular trunk portion 6 formed about the longitudinal axis 5 and a holder portion 7 extending upwardly from the trunk portion 6. As FIG. 5 shows, the holder portion 7 is bent upon assembly in a direction along the lateral axis 8 which is perpendicular to the longitudinal axis 5.

The trunk portion 6 has a coupling mouth 9 for receiving a mating connector and a connection opening 10 for connecting a coaxial cable 4. The lower portion of the L-shaped dielectric member 2 is housed in the trunk portion 6 and has an aperture 2*a* for receiving the coupling portion 3*a* of the L-shaped central terminal 3. The upper portion is inserted in the connection opening 10 for holding the connection portion 3*b* of the central terminal 3 which is connected to the coaxial cable 4. As FIG. 4 shows, an upper side wall extends upwardly in parallel to the longitudinal axis 5 before assembly. When the holder portion 7 is bent, the upper side wall is bent in a direction of the lateral axis 8 and crimped to the coaxial cable 4.

Figure 6:
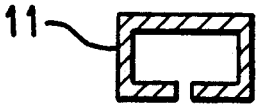
FIG. 6 is a cross section of a holder portion of the coaxial cable connector.

The holder portion 7 has a projection 7*a* for crimping the dielectric member 2. The holder portion 7 also has a pair of wing portions 11 which are bent in rectangular cross section as shown in FIG. 6 after the holder portion 7 is bent so that the wing portions 11 support the rear portion of the dielectric member 2.

As described above, this connector requires no outer terminal and is easy to assemble. The connector structure is so simple that it is possible to provide a miniature connector. How a coaxial cable is connected to such a coaxial cable connector is described below.

In FIG. 1, a length of outer jacket 12 is removed to expose a shield wire 13, an inner dielectric member 14, and a central conductor 15.

In FIG. 2, a tubular ferrule 16 made from a metal is pushed into a space between the shield wire 13 and the inner dielectric member 14 for reinforcement.

In FIG. 3, the central conductor 15 of the coaxial cable 4 is crimped to the U-shaped connection portion 3*b* of the central terminal 3. The prepared coaxial cable 4 is assembled into the connector as follows.

In FIG. 4, the coupling portion 3*a* of the central terminal 3 is inserted into the aperture 2*a* of the dielectric member 2.

In FIG. 5, the holder portion 7 of the outer conductive shell 1 is bent in a direction of the lateral axis 8, with the upper portion of the dielectric member 2 bent by means of the projection 7*a*, and crimped over the dielectric member 2, the central terminal 3, and the central conductor 15.

In FIG. 6, the wing portions 11 are bent in rectangular form to cover the rear portion of the dielectric member 2. The front portion of the holder portion 7 is then crimped to the coaxial cable 4 for assuring firm connection between the coaxial cable 4 and the connector.

As has been described above, according to the invention, it is easy to prepare the end portion of a coaxial cable without using solder and any separate outer terminal and assemble the connector by merely crimping the outer conductive shell.

I claim:

1. A coaxial cable connector comprising:

an L-shaped outer conductive shell having a tubular trunk section with a front coupling mouth and a rear connection opening and a holder section extending laterally from said trunk section for holding a coaxial cable;

an L-shaped dielectric member housed in said outer conductive shell and having a front tubular portion with an aperture therein and a rear portion extending laterally from said front tubular portion into said holder section of said outer conductive shell for holding said coaxial cable; and a central terminal housed in said aperture and having a front portion for contact with a mating connector and a rear portion for connection to a central conductor of said coaxial cable.

2. A method of connecting a coaxial cable to a coaxial cable connector of claim 1, which comprises the steps of:

removing a length of outer jacket of a coaxial cable to expose a shield wire, an inner dielectric member, and a central conductor;

crimping said central conductor to a rear portion of said central terminal outside said outer conductive shell to provide a central terminal-conductor assembly; and inserting a front portion of said central terminal-conductor assembly into said front section of said dielectric member, thereby facilitating connection of said central conductor to said central terminal.

3. The method of claim 2, which further comprises a step of bending said wing portions around said rear portion of said dielectric member.

4. The method of claim 2, which further comprises, between the removing and crimping steps, a step of pushing a tubular ferrule into a space between said shield wire and said inner dielectric member for reinforcement.

5. A coaxial cable connector comprising:

an L-shaped outer conductive shell having a tubular trunk section with a front coupling mouth and a rear connection opening and a holder section extending laterally from said trunk section for holding a coaxial cable;

an L-shaped dielectric member housed in said outer conductive shell and having a front tubular portion with an aperture therein and a rear portion extending laterally from said front tubular portion beyond said tubular trunk section into said holder section of said outer conductive shell for holding said coaxial cable; and an L-shaped central terminal having a front portion housed in said aperture for contact with a mating connector and a rear portion extending laterally from said front portion and having a U-shaped cross-section for connection by crimping to a central conductor of said coaxial cable.

6. The coaxial cable connector of claim 1, wherein said holder section has a pair of wing portions bent around said rear portion of said dielectric member.

7. The coaxial cable of claim 6, wherein said pair of wing portions are bent around said rear portion of said dielectric member in rectangular cross-section.

* * * * *